United States Patent [19]

Faria

[11] Patent Number: 4,495,265

[45] **Date of Patent: * Jan. 22, 1985**

[54] ELECTROPHOTOGRAPHIC COPPER DOPED CADMIUM SULFIDE MATERIAL AND METHOD OF MAKING

[75] Inventor: Sixdeniel Faria, Towanda, Pa.

[73] Assignee: GTE Products Corporation, Stamford, Conn.

[ * ] Notice: The portion of the term of this patent subsequent to Dec. 22, 2000 has been disclaimed.

[21] Appl. No.: 233,806

[22] Filed: Feb. 12, 1981

Related U.S. Application Data

[63] Continuation-in-part of Ser. No. 128,330, Mar. 7, 1980, abandoned, and Ser. No. 147,902, May 8, 1980, abandoned.

[51] Int. Cl.[3] ..... G03G 5/08; G03G 5/087

[52] U.S. Cl. ..... 430/95; 430/136; 252/501.1

[58] Field of Search ..... 430/94, 95, 136; 252/501.1

[56] References Cited

U.S. PATENT DOCUMENTS

| | | | |
|---|---|---|---|
| 2,958,932 | 11/1960 | Goercke | 252/501.1 X |
| 2,995,474 | 8/1961 | Pearlman | 252/501.1 X |
| 3,694,201 | 9/1972 | Behringer | 430/95 X |
| 4,104,065 | 8/1978 | Tarumi et al. | 430/136 |

FOREIGN PATENT DOCUMENTS

| | | | |
|---|---|---|---|
| 2426928 | 12/1974 | Fed. Rep. of Germany | 430/94 |

OTHER PUBLICATIONS

"Radiation Sensitive Cadmium Sulfide Powders", Res. Discl., No. 112, Aug. 1973, pp. 13–16.

*Primary Examiner*—Roland E. Martin, Jr.
*Attorney, Agent, or Firm*—James Theodosopoulos

[57] ABSTRACT

A CdS:Cu,Cl electrophotographic material suitable for use in the xerographic mode, contains 200 to 300 ppm Cu, 0.02 to 0.06 percent Cl, and has very good contrast voltage.

9 Claims, 2 Drawing Figures

ELECTROPHOTOGRAPHIC COPPER DOPED CADMIUM SULFIDE MATERIAL AND METHOD OF MAKING

This application is a continuation-in-part of Ser. No. 128,330, filed Mar. 7, 1980 and Ser. No. 147,902, filed on May 8, 1980 both abandoned.

BACKGROUND OF THE INVENTION

This invention relates to electrophotographic cadmium sulfide material, and more particularly relates to a copper activated cadmium sulfide material for use in the xerographic mode and to photoreceptor devices incorporating such material.

Cadmium sulfide activated with copper or silver is a well-known photoconductive material, which is useful, for example, in photocells, detectors and electrophotography.

In electrophotography, a photoreceptor surface bearing a photoconductive materal is given an electrical charge in the dark, and then an image is formed by the selective discharge of certain areas by illumination corresponding, for example, to the light reflective areas of an original document. The thusformed latent image is then transferred to copy paper and developed by the adherence of toner particles to the charged areas of the copper.

The initial charge on the photoreceptor surface may either be positive (as in the so-called canographic mode) or negative (as in the so-called xerographic mode).

While cadmium sulfide photoconductive material can be used in a photoreceptor device to obtain a surface charge of either polarity, its major use up to the present time has been mainly in the canographic mode. See, for example, U.S. Pat. No. 4,239,844 assiged to the present assignee, describing copper-activated cadmium sulfide containing cadmium selenide addition for use in the canographic mode.

Among the characteristics needed for a photoreceptor device for use in the xerographic mode are high charge acceptance, low residual voltage, high contrast voltage and high cyclic stability. Cyclic stability is the ability to maintain other electrical properties during multiple charge-discharge copy cycles. Cyclic fatigue is the tendency to gradually lose other electrical properties upon cycling, and is evidenced by a gradually decreasing quality of copies produced by the reprographic equipment.

Because these characteristics are different from those required in most photoconductive applications, the materials used in the photoreceptor devices described herein are referred to as electrophotographic materials, rather than photoconductive materials.

Selenium has been used extensively as the electrophotographic material in the xerographic mode. The development of a cadmium sulfide-type photoconductive material for use in the xerographic mode is attractive, however, due to its expected lower cost relative to selenium. Zinc oxide, another potential low-cost candidate for replacement of selenium, is less desirable than cadmium sulfide because of its lower photosensitivity and poor cyclic stability.

SUMMARY OF THE INVENTION

In accordance with the invention, a copper activated cadmium sulfide material containing 200 to 300 parts per million of copper and 0.02 to 0.06 weight percent halide evidences good to excellent characteristics as an electrophotographic material in the xerographic mode. Accordingly, the invention includes photoreceptor devices comprising a layer of electrophotographic particles in a resin binder support matrix on a conductive substrate.

BRIEF DESCRIPTION OF THE INVENTION

DETAILED DESCRIPTION OF THE INVENTION

The starting materials for the preparation of the CdS:Cu,X material (where X is F, Cl, Br, or I) should be selected to avoid impurities which would adversely affect performance of the material in electrophotographic applications. Total impurities in the CdS starting material should be kept below about 20 ppm, and preferably below about 10 ppm.

The CdS starting material should have an average particle size below about 1.2 microns as determined by Fisher Sub Sieve Sizer. CdS material of the requisite purity and particle size may be obtained commercially, or produced by a suitable technique such as the so-called "co-precipitation" technique, wherein the copper is precipitated simultaneously with the CdS from aqueous solution.

Figure 2:
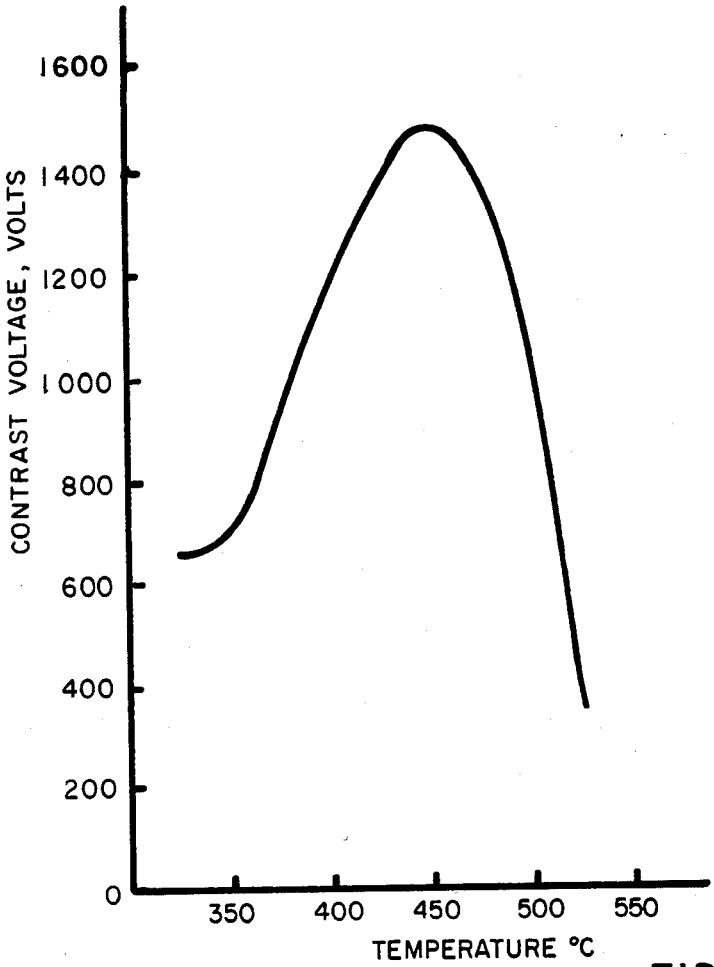
FIG. 2 is a curve showing the relationship of contrast voltage to the firing temperature of the electrophotographic material.

The electrophotographic material is formed by mixing the CdS with from 200 to 300 ppm (on a parts by weight basis) of copper and 0.3 to 1.0 weight percent of a halide flux of cadmium or an alkali metal, such as cadmium chloride, or potassium iodide, followed by heating the mixture at a relatively low temperature (to avoid excessive particle size growth) for a time sufficient to allow incorporation of the Cu activator into the CdS lattice. The presence of the flux is necessary to promote diffusion of the copper into the lattice during the low thermal treatment, and to obtain good xerographic properties. In general, heating in the range of 375° C. to 500° C. for from 1 to 5 hours will result in desired Xerographic properties and particle size. Too low a temperature or too short a time will result in insufficient incorporation of copper activator in the CdS lattice, while too high a temperature or too long a time will result in excessive particle size. FIG. 2 shows that optimum contrast voltage is obtained at a firing temperature of about 450° C.

Figure 1:
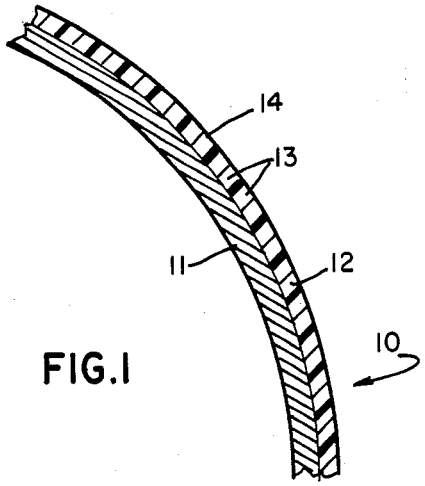
FIG. 1 is a sectional view of one embodiment of a photoreceptor device incorporating an electrophotographic material of the invention.

The electrophotographic material may be incorporated into a photoreceptor device by mixing the material with a solution of a suitable organic resin binder in an organic solvent, in the weight ratio of about 1.0:1 to 1.8:1 of material to solution, and coating the mixture onto a conductive substrate such as an aluminum drum. Examples of binder resins are epoxy resins and acrylic resins. Low to medium molecular weight solvents offer acceptable drying times. After drying, the coated drum can be inserted into reprographic equipment. FIG. 1 in the drawing shows a portion of a drum 10 sectioned to illustrate conductive substrate 11, and photoconductive layer 12 comprising particles 13 of CdS:Cu,X electrophotographic material in the resin binder matrix 14.

To illustrate the relationship of copper in the CdS:Cu,X to electrophotographic properties, a series of CdS:Cu,Cl samples, with varying levels of copper were prepared by the following procedure:

CdS samples containing various amounts of Cu (added from a CdS:Cu mix) and one weight percent of $CdCl_2$ were dry blended in a V-blender with an intensifier bar. The blended samples were fired at 425° C. for 1 hour in a flowing $N_2$ atmosphere. After cooling, the samples were washed successively with a 1 percent KCN solution and deionized water until the conductivity of the water was less than 10 micromhos. The samples were then dried at 130° C. for 4 hours.

Each sample was then mixed with a solution of an epoxy resin in the weight ratio of 1.3 to 1, and the mixture coated onto an aluminum drum surface to form a layer having a thickness when dry of about 1.6 mils. The epoxy resin used was a two part resin of diglycidyl ether bisphenol A and an aliphatic polyamine hardener, and was dissolved in a methyl isobutyl ketone solvent. The drums were successively installed in a piece of reprographic equipment and evaluated as photoreceptor devices for operation in the xerographic mode. The surface of the drum was subjected to a negative charge from a charging corona, and the charging voltage (defined as the amount of negative charge deposited on the surface) and the residual voltage (the voltage remaining after the surface has been exposed to light intensity of about 4 ft. candles) were measured by a Victoreen Model EPA.

The Victoreen consists of an adjustable corona charging source, a sample transfer mechanism, a vibrating reed electrometer, and an adjustable calibrated light source. In operation the sample is mounted in the transport mechanism (rotating turntable), and passes over the corona charging head at an adjustable rate (normally 800 rpm). The charging voltage is sensed by a platinum-coated probe and measured on the electrometer system. The voltage is recorded on an accessory strip chart recorder. The sample is exposed to a calibrated light source (4 foot candle) and the light decay rate measured.

The contrast voltage, which is indicative of image quality obtainable from operation of the equipment, was then determined to be the difference between accepted and residual voltage. Results are reported in Table I.

TABLE I

| Effect of Copper Concentration | | | |
|---|---|---|---|
| Copper ppm | Charging Voltage | Residual Voltage | Contrast Voltage |
| 100 | 400 | 180 | 220 |
| 150 | 960 | 200 | 760 |
| 200 | 1520 | 200 | 1320 |
| 225 | 1450 | 200 | 1250 |
| 250 | 1410 | 160 | 1250 |
| 275 | 1400 | 160 | 1240 |
| 300 | 1380 | 160 | 1220 |

As can be seen from Table I, very good contrast voltage, over 1000 volts, is obtained at 200 to 300 ppm copper. Above 300 ppm copper, darkening of the otherwise light body color of the CdS:Cu,Cl material begins to occur, which results in increased residual voltage and decreased contrast voltage. In present day xerographic equipment, contrast voltage is only about 400 to 800 volts.

During the heat treatment to form CdS:Cu,X, some X from the halide flux is incorporated into the CdS, about 0.02 to 0.06 percent by weight. This amount of X is not harmful to the xerographic properties of the material, and the presence of the flux is essential to the formation of good xerographic properties. In order to show the effect of preparation in the absence of flux, six CdS:Cu samples were prepared as described above with varying amounts of copper, but without flux being present during the heat treatment. Evaluation in reprographic equipment after formation of photoreceptor drums as described above, gave the results shown in Table II.

TABLE II

| EFFECT OF COPPER ON UNFLUXED CdS | | | |
|---|---|---|---|
| Copper ppm | Charging Voltage | Residual Voltage | Contrast Voltage |
| 200 | 620 | 380 | 240 |
| 250 | 680 | 560 | 120 |
| 300 | 600 | 400 | 200 |

Both charging voltage and residual voltage are too low, resulting in very low contrast voltage and very poor quality.

While there has been shown and described what are at present considered the preferred embodiments of the invention, it will be obvious to those skilled in the art that various changes and modifications may be made therein without departing from the scope of the invention as defined by the appended claims.

I claim:

1. A method for producing an electrophotographic copper-activated cadmium sulfide material, the method comprising:

(a) mixing copper-containing and cadmium chloride starting materials with cadmium sulfide in amounts corresponding to 200 to 300 parts per million of copper and 0.02 to 0.06 weight percent of a halide of a cation selected from the group consisting of cadmium and the alkali metals, and (b) heating the mixture at a temperature within the range of about 375° C. to 500° C. for from about 1 to 5 hours.

2. The method of claim 1 wherein the halide is chloride and the cation is cadmium.

3. The method of claim 1 wherein the mixture is heated at a temperature of about 450° C.

4. Electrophotographic copper-activated cadmium sulfide material containing copper within the range of about 200 to 300 parts per million, halide in the range of about 0.02 to 0.06 weight percent, and having very good contrast voltage prepared by the method of claim 1.

5. The cadmium sulfide material of claim 4 wherein impurities are below 20 ppm.

6. The cadmium sulfide material of claim 4 wherein the halide is chlorine.

7. A photoreceptor device comprising a conductive substrate and an electrophotographic layer thereon, the layer comprising particles of the material of claim 4, embedded in an organic resin binder support matrix.

8. The device of claim 2 wherein the resin binder is selected from the group consisting of epoxy and acrylic resin binders.

9. The device of claim 7 wherein the weight ratio of the electrophotographic material to resin binder is within the range of about 1.3:1 to 1.8:1.

* * * * *